US006032017A

United States Patent [19]

Jewell et al.

[11] Patent Number: 6,032,017

[45] Date of Patent: Feb. 29, 2000

[54] FIXING DEVICE USING AN ADJUSTABLE HEATER TO REDUCE CONTAMINATION ON MEDIA

[75] Inventors: Robert W. Jewell; Gary M. Peter, both of Boise, Id.

[73] Assignee: Hewlett-Packard Company, Palo Alto, Calif.

[21] Appl. No.: 09/289,164

[22] Filed: Apr. 9, 1999

[51] Int. Cl.[7] ..... G03G 15/20; H05B 1/00

[52] U.S. Cl. ..... 399/336; 219/216; 399/335

[58] Field of Search ..... 219/216; 399/328, 399/330, 331, 334, 335, 336, 338, 67, 69, 70

[56] References Cited

U.S. PATENT DOCUMENTS

| | | | |
|---|---|---|---|
| 4,021,107 | 5/1977 | Morita | 399/69 |
| 4,920,250 | 4/1990 | Urban | 399/69 |
| 5,378,576 | 1/1995 | Sakai et al. | 430/126 |
| 5,391,450 | 2/1995 | Nagatsuka et al. | 430/99 |
| 5,640,658 | 6/1997 | Inoue et al. | 399/298 |
| 5,695,902 | 12/1997 | Mikuriya et al. | 430/110 |
| 5,708,920 | 1/1998 | Ohnishi et al. | 399/69 |
| 5,784,675 | 7/1998 | Inoue et al. | 399/297 |
| 5,805,968 | 9/1998 | Chatterjee et al. | 399/324 |

*Primary Examiner*—Matthew S. Smith
*Assistant Examiner*—Hoang Ngo
*Attorney, Agent, or Firm*—Gregg W. Wisdom

[57] ABSTRACT

A fixing device includes a fusing roller, a backing roller and an adjustable heater for selectively heating the fusing roller and the backing roller. The adjustable heater includes a heating element and a reflector. The reflector can be positioned to direct heat from the heating element upon the fusing roller or the backing roller. The reflector is coupled to the shaft of a solenoid. Positioning of the reflector is controlled by alternately energizing or de-energizing the solenoid. During the time period between the passing of successive units of the media through the fixing device, the reflector is positioned to heat the backing roller. Heating the backing roller melts toner accumulated on its surface. When the next unit of the media passes between the fusing roller and the backing roller, toner accumulated on the surface of the backing roller is moved onto to the media. By heating the backing roller between the passage of successive units of the media, the quantity of toner that accumulates on the surface backing roller remains small so that the severity of print defects is reduced.

20 Claims, 4 Drawing Sheets

FIXING DEVICE USING AN ADJUSTABLE HEATER TO REDUCE CONTAMINATION ON MEDIA

FIELD OF THE INVENTION

This invention relates to the fixing of toner to media in an electrophotographic imaging system. More particularly, this invention relates to a fixing device used in an electrophotographic imaging system.

BACKGROUND OF THE INVENTION

Heating elements have been used to fix toner to media in electrophotographic printing. Some fixing devices use a fixing member formed of one or more resistive heating elements enclosed in a halogen filled glass bulb and inserted into a cylinder formed of a thermally conductive material such as aluminum. The exterior surface of the cylinder has a release layer formed from a low adhesion material, such as TEFLON, to reduce toner adhesion to the surface. This embodiment of a fixing device is typically referred to as a halogen bulb fuser. Other fixing devices use a fixing member constructed of one or more flat resistive heating elements formed onto a ceramic substrate and surrounded by a sleeve made from a low adhesion flexible material. This embodiment of a fixing device is typically referred to as an instant on fuser.

For either a halogen bulb fuser or an instant on fuser, a backing member, such as a backing roller, rotates in contact with the surface of the fixing member. As media, having unfixed toner, moves between the fixing member and the backing roller, some of the toner may adhere to the surface of the fixing member even though it has a low adhesion coating.

The toner that adheres to the fixing member results in contamination of the backing roller by transfer of the toner from the fixing member to the backing roller. In a conventional fixing device, the surface temperature of the backing roller is lower than the surface temperature of the fixing member. As the backing roller rotates in contact with the fixing member, toner on the surface of the fixing member is cooled as it contacts the backing roller. The cooling of this toner causes it to adhere to the surface of the backing roller and pull away from the fixing member. Over time, significant amounts of toner can accumulate on the backing roller. The accumulated toner can break free and become fixed to the media resulting in a print defect on the media. A need exists for a fixing device that will reduce the severity of this type of print defect.

SUMMARY OF THE INVENTION

Accordingly, a fixing device for fixing toner to media, includes a fixing member and a backing member contacting the fixing member. The fixing device further includes an adjustable heater positioned relative to the fixing member and the backing member to selectively heat the fixing member and the backing member. By heating the backing member, toner accumulated onto the backing member is removed as the media passes between the fixing member and the backing member.

An electrophotographic imaging system to fix an image formed from toner to media includes an imaging device to form the image from the toner on the media and a fixing device for fixing the toner to the media. The fixing device includes a fixing member and a backing member contacting the fixing member. The fixing device further includes an adjustable heater positioned relative to the fixing member and the backing member to selectively heat the fixing member and the backing member. By heating the backing member toner accumulated onto the backing member is removed as the media passes between the fixing member and the backing member.

An electrophotographic imaging system for forming images on media from toner includes a fixing device having a fixing member and a backing member. A method for removing the toner from the backing member includes heating the backing member without the media present between the fixing member and the backing member. The method further includes moving the media between the fixing member and the backing member to move the toner from the backing member onto the media.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the embodiments of the fixing device will be disclosed in the context of a monochrome electrophotographic printer, one of ordinary skill in the art will recognize by understanding this specification that the fixing device has applicability in both color and monochrome electrophotographic imaging systems. Furthermore, one of ordinary skill in the art will recognize by understanding this specification that other types of electrophotographic imaging systems such as electrophotographic copiers could benefit from use of the fixing device. Additionally, although the fixing device will be discussed in the context of a halogen bulb fuser, it should be recognized that the principles disclosed are applicable to other fixing devices, such as an instant on fuser.

Figure 1:
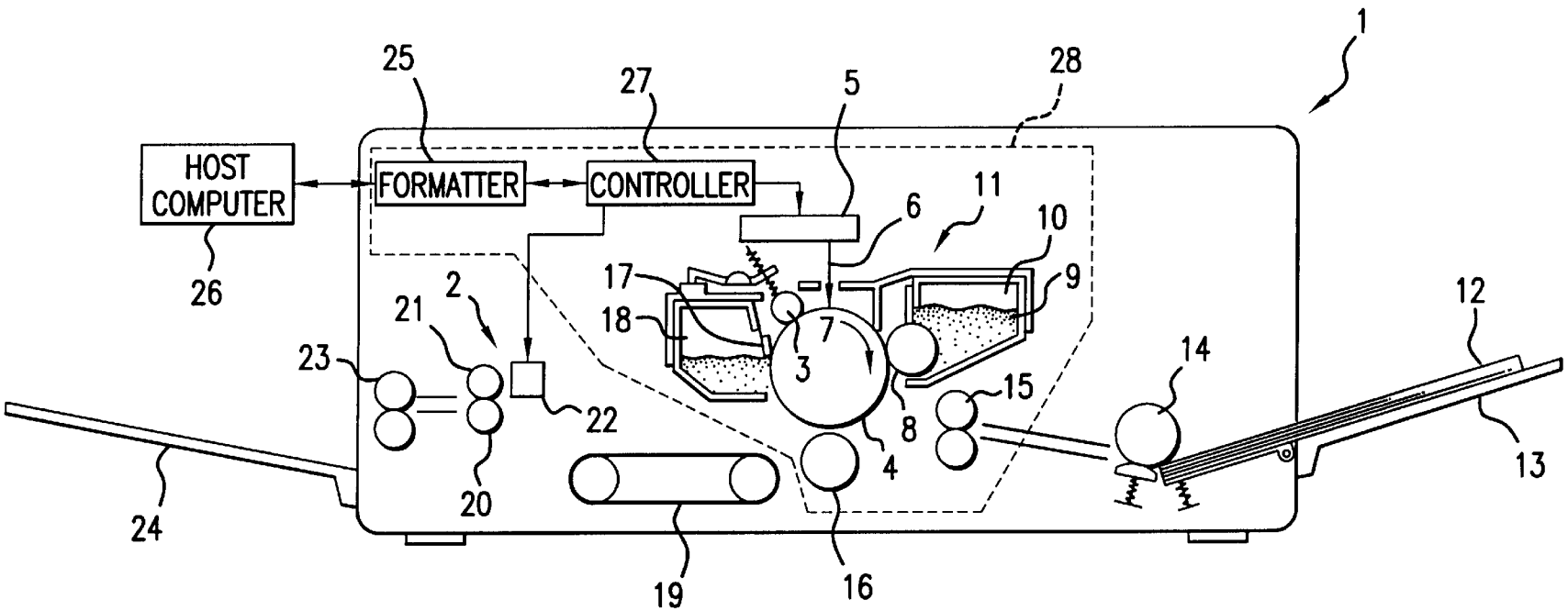
FIG. 1 is a simplified cross section of an electrophotographic printer including an embodiment of the fixing device.

Referring to FIG. 1, shown is a simplified cross sectional view of an electrophotographic imaging system, such as electrophotographic printer 1, containing an embodiment the fixing device, such as fixing device 2. Charge roller 3 is used to charge the surface of photoconductor drum 4 to a predetermined voltage. A laser diode (not shown) inside laser scanner 5 emits a laser beam 6 which is pulsed on and off as it is swept across the surface of a photoconductor, such as photoconductor drum 4, to selectively discharge the surface of the photoconductor drum 4 and form a latent electrostatic image. If the electrophotographic imaging system included an electrophotographic copier, the latent electrostatic image could be formed by a flash bulb to illuminate the object to be copied and the necessary optics to guide the reflected light onto the photoconductor.

Photoconductor drum 4 rotates in the clockwise direction as shown by the arrow 7. Developer roller 8 is used to develop the latent electrostatic image residing on the surface of photoconductor drum 4 after the surface voltage of the photoconductor drum 4 has been selectively discharged. Toner 9 which is stored in the toner reservoir 10 of electrophotographic print cartridge 11 moves from locations within the toner reservoir 10 to the developer roller 8. The magnet located within the developer roller 8 magnetically attracts the toner to the surface of the developer roller 8. As the developer roller 8 rotates in the counterclockwise direction, the toner on the surface of the developer roller 8, located opposite the areas on the surface of photoconductor drum 4 which are discharged, is moved across the gap between the surface of the photoconductor drum 4 and the surface of the developer roller 8. This movement of toner develops the latent electrostatic image. A high voltage bias applied to developer roller 8 creates the electric field necessary to project toner from developer roller 8 onto photoconductor drum 4.

Media 12 is loaded from media tray 13 by pickup roller 14 into the media path of the electrophotographic printer 1. Media 12 moves through the drive rollers 15 so that the arrival of the leading edge of media 12 below photoconductor drum 4 is synchronized with the rotation of the region on the surface of photoconductor drum 4 having a latent electrostatic image corresponding to the leading edge of media 12. As the photoconductor drum 4 continues to rotate in the clockwise direction, the surface of the photoconductor drum 4, having toner adhered to it in the discharged areas, contacts the media 12. The side of media 12, opposite the surface to which toner is to be transferred, is charged by transfer roller 16 before media 12 contacts toner on photoconductor drum 4. The charge on media 12 attracts toner away from the surface of the photoconductor drum 4 and onto media 12. The transfer of toner from the surface of photoconductor drum 4 to the surface of the media 12 is not completely efficient and therefore some toner remains on the surface of photoconductor drum 4. As photoconductor drum 4 continues to rotate, toner which remains adhered to its surface is removed by cleaning blade 17 and deposited in waste hopper 18.

As media 12 moves in the media path past photoconductor drum 4, conveyer belt 19 delivers the media 12 to fixing device 2. Fixing device 2 includes a backing member, such as backing roller 20, and a fixing member, such as fusing roller 21 positioned so that they are in contact. Before media 12 passes between backing roller 20 and fusing roller 21, an embodiment of an adjustable heater, such as adjustable heater 22, has heated the surface of fusing roller 21 in preparation for fixing toner to the surface of media 12. Media 12 that passes between backing roller 20 and fusing roller 21 is forced against fusing roller 21 during the fixing operation. Backing roller 20 also provides the drive force to rotate fusing roller 21 and pull media 12 through the contact region between fusing roller 21 and backing roller 20. At the fixing device 2, heat is applied to media 12 by fusing roller 21 so that the toner is fixed to the surface of media 12. Output rollers 23 push media 12 into output tray 24 after exiting fixing device 2.

Formatter 25 receives print data, such as a display list, vector graphics, or raster print data, from the print driver operating in conjunction with an application program in host computer 26. Formatter 25 converts this relatively high level print data into a stream of binary print data. Formatter 25 sends the stream of binary print data to controller 27. Controller 27 supplies the stream of binary print data to laser scanner 5. The binary print data stream sent to the laser diode in laser scanner 5 pulses the laser diode to create the latent electrostatic image on photoconductor drum 4. Controller 27 also generates signals that control the various assemblies in electrophotographic printer 1 necessary for performing the electrophotographic imaging process. These assemblies could include a motor (not shown in FIG. 1) that provides drive for pickup roller 14, transfer roller 16, conveyor belt 19, and backing roller 20.

At a high level, an electrophotographic imaging system can be regarded as including an imaging device, such as imaging device 28, that includes the hardware (such as laser scanner 5, photoconductor drum 4, developer 8, and transfer roller 16) necessary to form the image from the toner on the media. The electrophotographic imaging system further include a fixing device, such as fixing device 2.

Fixing device 2 includes backing roller 20, fusing roller 21, and adjustable heater 22. Adjustable heater 22 has the capability to selectively heat either backing roller 20 or fusing roller 21. Controller 27 can selectively control whether adjustable heater 22 heats backing roller 20 or fusing roller 21. During the fixing operation, adjustable heater 22 is configured to direct heat upon fusing roller 21. Just prior to removal of toner from backing roller 20, adjustable heater 22 is configured to heat backing roller 20. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

Figure 2:
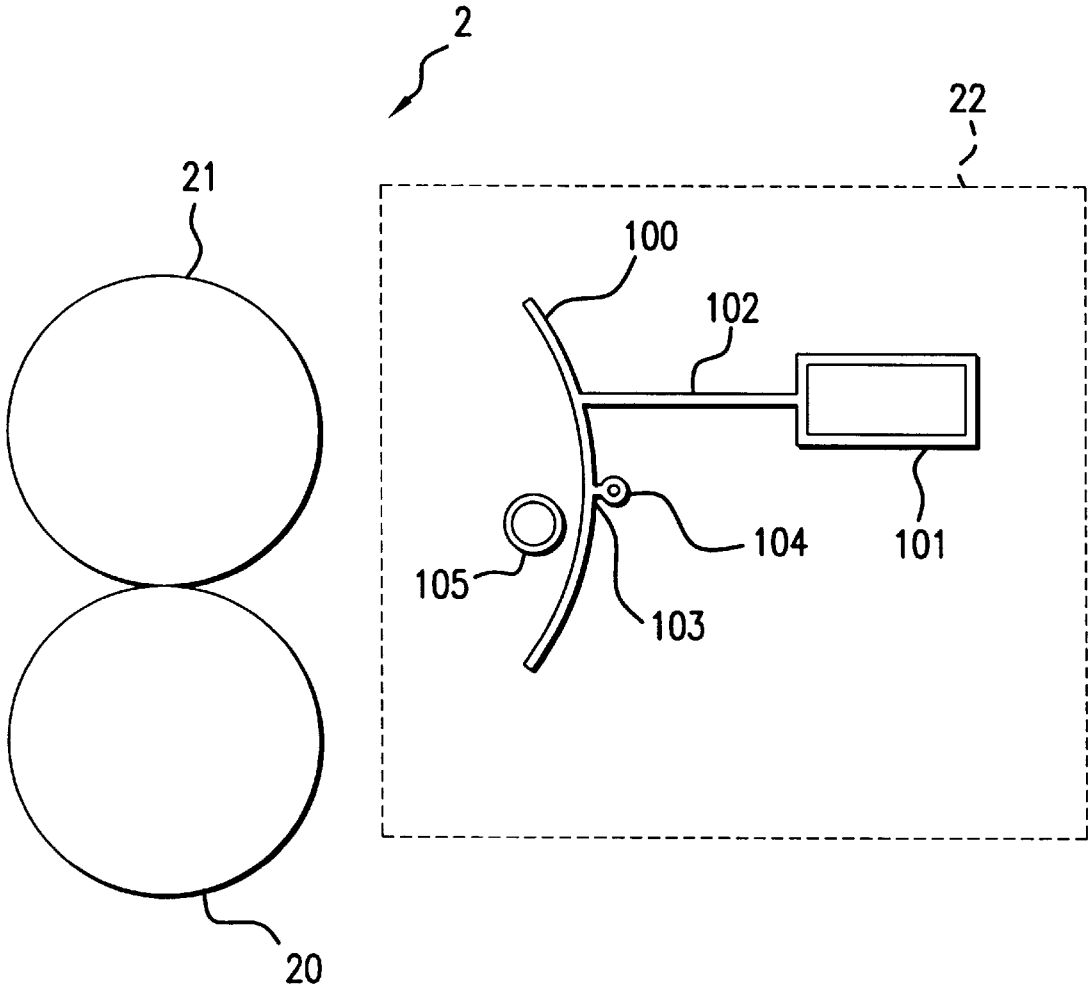
FIG. 2 shows an embodiment of the fixing device with a reflector positioned for heating the fusing roller.

Shown in FIG. 2 is an embodiment of fixing device 2 including an embodiment of adjustable heater 22. In FIG. 2, adjustable heater 22 is configured to heat fusing roller 21. With reflector 100 in a first position as shown in FIG. 2, heat from heating element 105 raises the temperature of fusing roller 21 so that when media 12 contacts the surface of fusing roller 21, toner is fixed to media 12.

The embodiment of adjustable heater 22 includes a reflector 100. Reflector 100 can be configured to selectively direct heat energy toward fusing roller 21 or backing roller 20. Adjustable heater 22 further includes solenoid 101 having a shaft 102 coupled to reflector 100. Reflector 100 is pivotally attached at pivot point 103 by a member 104. Member 104 is attached to structure inside of electrophotographic printer 1. Adjustable heater 22 also includes heating element 105.

Figure 3:
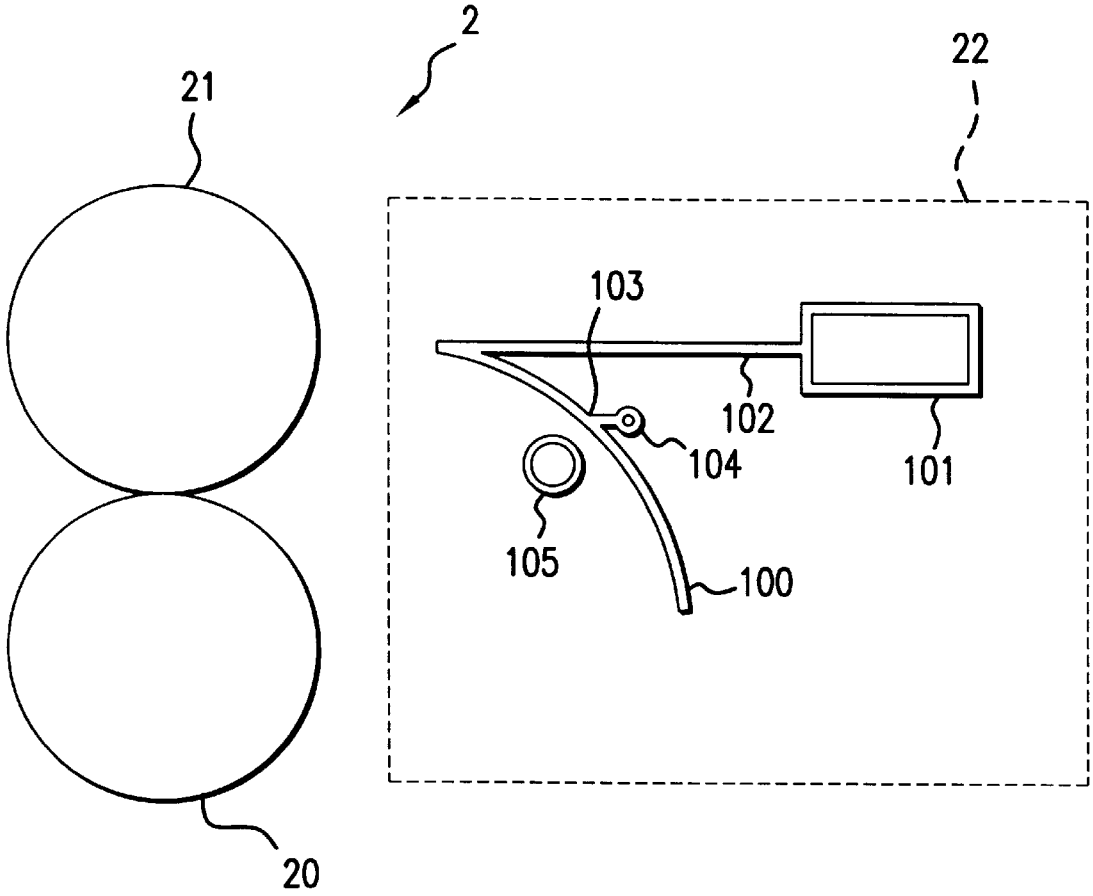
FIG. 3 shows an embodiment of the fixing device with the reflector positioned for heating the backing roller.

FIG. 3 shows the condition in which adjustable heater 22 is configured to heat backing roller 20. In FIG. 3, reflector 100 is positioned so that it faces backing roller 20. In this position, reflector 100 will direct heat energy toward backing roller 20, thereby melting toner accumulated onto the surface of backing roller 20.

Shaft 102 includes a linkage that is constrained to move in a slot on reflector 100 so that when shaft 102 extends out from solenoid 101, the linkage on the end of shaft 102 slides in the slot toward the top of reflector 100. As shaft 102 extends from solenoid 101, reflector 100 rotates about pivot point 103 so that it faces backing roller 20. Controller 27 sends a signal to solenoid 101 to control the movement of shaft 102. Solenoid 101 is constructed with an internal bias spring to extend shaft 102 and rotate reflector 100 to face backing roller 20 when it is not energized. When solenoid 101 is energized by the signal from controller 27, shaft 102 is retracted into solenoid 101 and rotates reflector 100 to face fusing roller 21. With reflector 100 positioned as shown in FIG. 2, heat generated by heating element 105 is directed onto fusing roller 21. Heating element 105 raises the surface temperature of fusing roller 21 sufficiently to melt toner contacting its surface.

In FIG. 3, an embodiment of fixing device 2 is shown with reflector 100 in a second position. With reflector 100 in the second position, heat from heating element 105 is directed onto backing roller 20. The heat from heating element 105 melts toner present on backing roller 20 so that when media 12 moves between backing roller 20 and fusing roller 21, melted toner moves from backing roller 20 onto the side of media 12 opposite the image.

In the embodiments of fixing device 2 shown in FIG. 2 and FIG. 3, reflector 100 is pivotally mounted on member 104. It should be recognized that other structure could be used to implement the functions of adjustable heater 22. For example, a reflecting structure could be mounted onto a rotatable shaft so that as the shaft rotates the reflecting structure will rotate. This would permit the positioning of reflector 100 to face either fusing roller 21, backing roller 20, or some position in between. Alternatively, a reflecting structure could be driven by gears to rotate the reflecting structure from a position facing fusing roller 21 to a position facing backing roller 20, or any position in between.

In a conventional fixing device, with the backing roller unheated, toner that offsets onto the fusing roller during the fixing operation will, over time, accumulate onto the backing roller. While heat is applied to the fusing roller, toner on the surface of fusing roller will be in a viscous state. Over time, as the fusing roller contacts the backing roller, this toner will transfer to the backing roller. Because of heating from the fusing roller, the toner accumulated on the backing roller will remain soft, although not in a liquid state. When a sufficient amount of toner accumulates on the surface of backing roller, toner will break free from the backing roller and adhere to media passing between the backing roller and the fusing roller. This toner results in a print defect.

Figure 4:
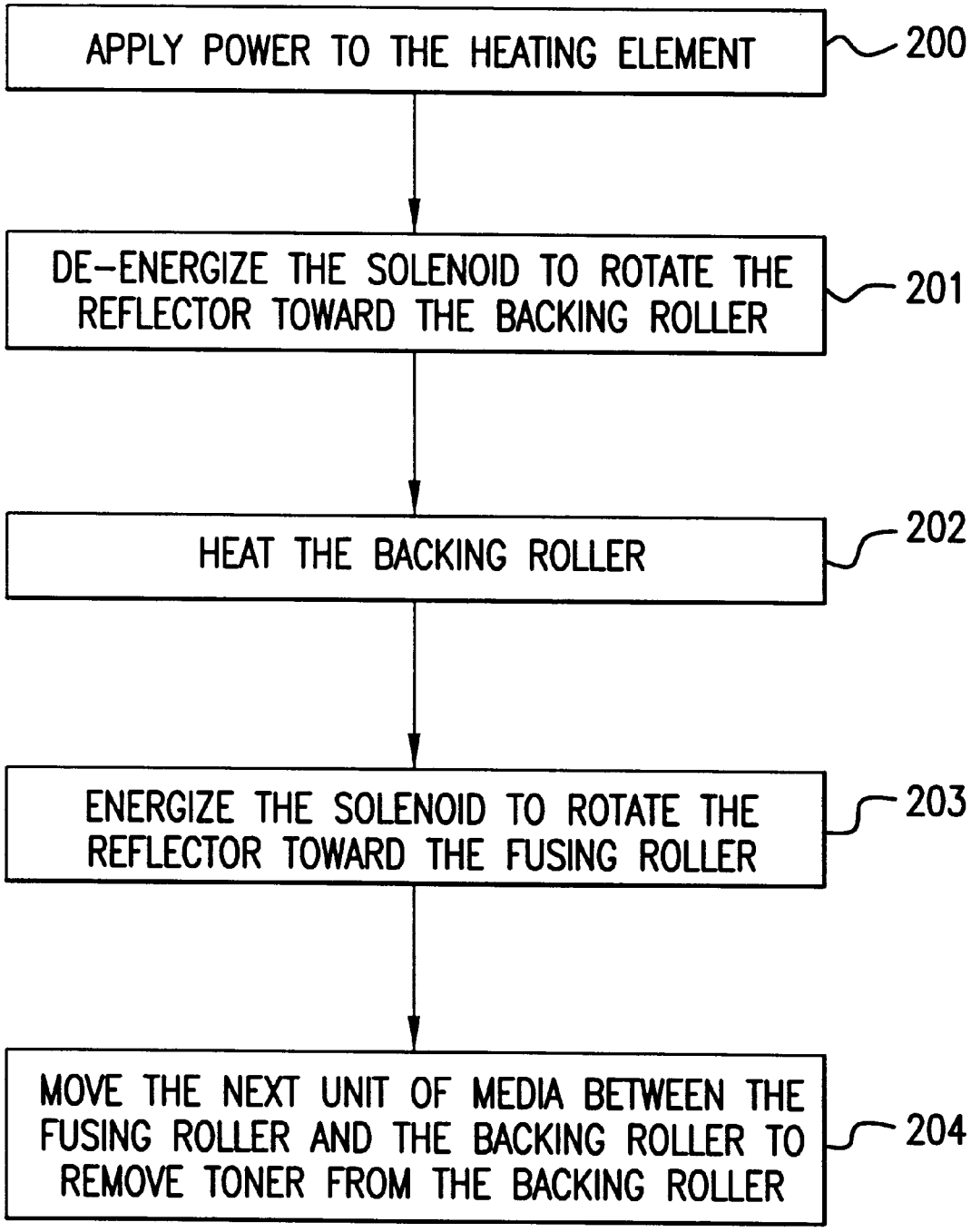
FIG. 4 shows a high level flow diagram of a method of the using the fixing device.

Shown in FIG. 4 is high level flow diagram of a method for using fixing device 2 to substantially reduce the severity of print defects resulting from toner accumulating on backing roller 20. The method involves heating backing roller 20 after each unit of media 12 moves out of fixing device 2. In a first step 200, power is applied to heating element 105. Because heating element 105 provides heat for fixing toner to media 12, power must be applied to heating element 105 sufficiently early to permit heating of fusing roller 21 for the fixing operation. Then, in step 201, very shortly after a unit of media 12 passes from between backing roller 20 and fusing roller 21, controller 27 de-energizes solenoid 101. This permits shaft 102 to extend from solenoid 101 and rotate reflector 100 to face backing roller 20 as shown in FIG. 3. Next in step 202, heat from heating element 105 is reflected by reflector 100 onto backing roller 20, thereby providing heat to melt toner on the surface of backing roller. Then, in step 203, controller 27 energizes solenoid 101. This causes shaft 102 to retract into solenoid 101 and rotate reflector 100 to face fusing roller 20. In this position, reflector 100 directs heat onto the surface of fusing roller 21 in preparation for the fixing operation. Finally, in step 204, the next unit of media 12 passes between fusing roller 21 and backing roller 20 to fix toner transferred from photoconductor drum 4 onto media 12 to its surface. At this time, toner on the surface of backing roller 20 is still melted and therefore adheres to media 12, removing it from the surface of backing roller 20.

The heating of toner on backing roller 20 occurs in the time period between the passage of successive units of media 12 through fixing device 2. Because the heating of backing roller 20 occurs before each unit of media 12 passes through fixing device 2, there is not an opportunity for a substantial amount of toner to accumulate on backing roller 20. As a result, toner that adheres to media 12 does so in such small quantities that print defects visible to the unaided eye do not occur.

It should be recognized that other methods of applying heat to backing roller 20 to prevent toner accumulation could be effective in reducing the severity of print defects. For example, controller 27 could control the application of heat to backing roller 20 so that heating occurred between the next to last and the last unit of media 12 in the print job. Or, controller 27 could control the application of heat to backing roller 20 so that heating occurred after a predetermined number units of media 12 passed through electrophotographic printer 1. Or, controller 27 could periodically move a unit of media 12 through the media path for the purpose of removing toner from backing roller 20. Although these alternate methods may not prevent toner accumulation as effectively as the method disclosed in FIG. 4, they may sufficiently remove accumulated toner to prevent the occurrence of print defects visible to the unaided eye.

Fixing device 2 can provide the advantages of heating backing roller 20 and fusing roller 21 without the increased cost and complexity involved in having a separate heating element for each of these rollers. It may be less expensive to accomplish heating of backing roller 20 by using a single heating element 105 and reflector 100 than by using separate heating elements to heat backing roller 21 and fusing roller 21. Additionally, fixing device 2 provides the advantage of reduced power consumption. Because heat is applied to backing roller 20 during the time period between the passage of successive units of media 12 through fixing device 2, less power is consumed than would be if power were continuously applied to two separate heating elements.

Although several embodiments of the invention have been illustrated, and their forms described, it is readily apparent to those of ordinary skill in the art that various modifications may be made to these embodiments without departing from the spirit of the invention or from the scope of the appended claims.

What is claimed is:

1. A fixing device for fixing toner to media, comprising:

a fixing member;

a backing member contacting the fixing member; and an adjustable heater configured to selectively alternate between a first state to heat the fixing member and a second state to heat the backing member.

2. The fixing device as recited in claim 1, wherein:

the adjustable heater includes a heating element and a reflector, with the heating element positioned between the reflector and the fixing member;

the first state corresponds to a first position of the reflector to reflect heat toward the fixing member;

the second state corresponds to a second position of the reflector to reflect heat toward the backing member; and the reflector includes a configuration to move between the first position and the second position.

3. The fixing device as recited in claim 2, wherein:

the fixing member includes a fusing roller.

4. The fixing device as recited in claim 3, wherein:

the backing member includes a backing roller.

5. The fixing device as recited in claim 4, wherein:

the fixing device includes a configuration to locate the reflector in the second position without the media between the fusing roller and the backing roller.

6. The fixing device as recited in claim 5, further comprising:

means for moving the reflector between the first position and the second position coupled to the reflector.

7. The fixing device as recited in claim 6, further comprising:

a controller coupled to the means for moving, with the controller configured to provide a signal to the means for moving for placing the reflector in the first position or the second position responsive to the signal.

8. An electrophotographic imaging system to fix an image formed from toner to media, comprising:

an imaging device to form the image from the toner on the media; and a fixing device for fixing the toner to the media including a fixing member, a backing member contacting the fixing member, and an adjustable heater configured to selectively alternate between a first state to heat the fixing member and a second state to heat the backing member.

9. The electrophotographic imaging system as recited in claim 8, wherein:

the adjustable heater includes a heating element and a reflector, with the heating element positioned between the reflector and the fusing roller;

the first state corresponds to a first position of the reflector to reflect heat toward the fixing member;

the second state corresponds to a second position of the reflector to reflect heat toward the backing member; and the reflector includes a configuration to move between the first position and the second position.

10. The electrophotographic imaging system as recited in claim 9, wherein:

the fixing member includes a fusing roller.

11. The electrophotographic imaging system as recited in claim 10, wherein:

the backing member includes a backing roller.

12. The electrophotographic imaging system as recited in claim 11, wherein:

the fixing device includes a configuration to locate the reflector in the second position without the media between the fusing roller and the backing roller.

13. The electrophotographic imaging system as recited in claim 12, further comprising:

means for moving the reflector between the first position and the second position coupled to the reflector.

14. The electrophotographic imaging system as recited in claim 13, further comprising:

a controller coupled to the means for moving, with the controller configured to provide a signal to the means for moving for placing the reflector in the first position or the second position responsive to the signal.

15. The electrophotographic imaging system as recited in claim 14, wherein:

the electrophotographic imaging system comprises an electrophotographic printing system.

16. The electrophotographic imaging system as recited in claim 15, wherein:

the imaging device includes a photoconductor, means for forming a latent electrostatic image on the photoconductor, a developing device located adjacent the photoconductor and configured to move the toner onto the latent electrostatic image, and a transfer device located adjacent the photoconductor and configured to move the toner from the photoconductor onto the media prior to movement of the media to the fixing device.

17. In an electrophotographic imaging system for forming images on media from toner including a fixing device having a fixing member and a backing member, a method for removing the toner from the backing member comprising:

heating the backing member without media present between the fixing member and the backing member; and moving the media between the fixing member and the backing member to move the toner from the backing member onto the media.

18. With the fixing device including an adjustable heater, the method as recited in claim 17, wherein:

heating the backing member includes configuring the adjustable heater for heating the backing member.

19. With the adjustable heater including a reflector and a heating element positioned between the reflector and the fixing member, the method as recited in claim 18, wherein:

heating the backing member includes moving the reflector to direct heat upon the backing member.

20. The method as recited in claim 19, further comprising:

applying power to the heating element with applying power to the heating element occurring before heating the backing member.

* * * * *